US006974033B2

(12) United States Patent
McLeod et al.

(10) Patent No.: US 6,974,033 B2
(45) Date of Patent: Dec. 13, 2005

(54) WRAPAROUND-STYLE SHIPPING CONTAINERS CONVERTIBLE TO DISPENSING OR DISPLAY CONTAINERS

(75) Inventors: Michael B. McLeod, Romeoville, IL (US); Oscar Rochefort, Naperville, IL (US)

(73) Assignee: Smurfit-Stone Container Enterprises, Inc., Chicago, IL (US)

( * ) Notice: Subject to any disclaimer, the term of this patent is extended or adjusted under 35 U.S.C. 154(b) by 0 days.

(21) Appl. No.: 10/429,510

(22) Filed: May 5, 2003

(65) Prior Publication Data

US 2004/0222127 A1 Nov. 11, 2004

(51) Int. Cl.[7] ..... B65D 1/22; B65D 17/00; B65D 5/54

(52) U.S. Cl. ..... 206/736; 229/200; 229/235

(58) Field of Search ..... 206/746–750, 206/774, 738, 766, 736, 784, 273, 525.1; 229/164, 235, 103.2, 103.3, 125.19, 125.33, 229/122.33, 240–244, 122.32, 200

(56) References Cited

U.S. PATENT DOCUMENTS

| | | | |
|---|---|---|---|
| 1,682,449 | A | 8/1928 | Vest |
| 1,770,226 | A | 7/1930 | Bliss |
| 1,770,618 | A | 7/1930 | Lambert |
| 1,916,045 | A | 6/1933 | Freymann |
| 2,152,079 | A | 3/1939 | Mott |
| 2,218,360 | A | 10/1940 | Rokol |
| 2,343,222 | A | 2/1944 | Nelson |
| 2,569,963 | A | 10/1951 | Ward |
| 2,887,389 | A | 5/1959 | Linville |
| 3,276,667 | A | 10/1966 | Johnson et al. |
| 3,335,940 | A | 8/1967 | Dykes |
| 3,447,733 | A | 6/1969 | Smith et al. |
| 3,531,045 | A | 9/1970 | Johnson |
| 3,917,158 | A | 11/1975 | Dorofachuk et al. |
| 3,941,303 | A | 3/1976 | Wilbur |
| 3,979,046 | A | 9/1976 | Wilbur |
| 4,058,206 | A | 11/1977 | Morse et al. |
| 4,350,281 | A | 9/1982 | Dornbusch et al. |
| 4,382,504 | A | 5/1983 | Vesborg |
| 4,427,108 | A | 1/1984 | Coles et al. |
| 4,437,569 | A | 3/1984 | Sorenson |

(Continued)

FOREIGN PATENT DOCUMENTS

| | | |
|---|---|---|
| BE | 656551 | 4/1967 |

(Continued)

*Primary Examiner*—Mickey Yu
*Assistant Examiner*—J. Gregory Pickett
(74) *Attorney, Agent, or Firm*—Armstrong Teasdale LLP

(57) ABSTRACT

Wraparound style packaging and shipping containers are provided, having structures configured for facilitating the conversion of the shipping containers into dispensing or all-around display containers. The shipping containers are preferably fabricated from an outer blank having a centrally positioned bottom wall, with front and rear walls emanating from front and rear edges of the bottom wall, respectively. Inner reinforcement panels may be provided for one or more of the end panels. The containers may incorporate lids formed from separate blanks, or lids formed from integral top panels of the wraparound blanks. Side flaps emanate from the bottom wall, the front and rear walls, and the top panels (if present), to provide at least partial coverage of the sides of the container. In several embodiments, separable structures are located in at least one of the front and rear walls, and/or the side flaps, to enable greater or lesser portions of the upper structure of the container to be removed, for permitting varying degrees of access to the interior of the container. An interior divider structure may be provided, for structural stacking support both during shipping and display modes.

10 Claims, 17 Drawing Sheets

U.S. PATENT DOCUMENTS 4,437,570 A 3/1984 Sorenson
4,574,945 A 3/1986 Giblin
4,635,795 A 1/1987 DeFlander et al.
4,705,162 A 11/1987 Kupersmit
4,732,276 A * 3/1988 Knecht ..... 206/273
4,784,271 A 11/1988 Wosaba, II et al.
4,793,494 A 12/1988 Gordon, Jr.
4,871,067 A 10/1989 Valenti
5,048,690 A 9/1991 Zimmerman
5,143,278 A 9/1992 Petriekis et al.
5,203,495 A * 4/1993 Jorgensen-Beck et al. .. 206/273
5,293,991 A 3/1994 Neumann et al.
5,350,111 A 9/1994 Vosbikian
5,364,020 A 11/1994 Bansal
5,419,485 A 5/1995 Petriekis et al.
5,507,430 A 4/1996 Imhoff
5,520,325 A 5/1996 Quaintance
5,555,982 A 9/1996 Kuhn et al.
5,566,824 A 10/1996 Tack et al.
5,590,788 A 1/1997 Inman
5,622,309 A 4/1997 Matsuda et al.
5,651,497 A * 7/1997 Ventura et al. ..... 229/235
5,657,872 A * 8/1997 Leftwich et al. ..... 206/738
5,826,728 A 10/1998 Sheffer
5,842,576 A 12/1998 Snow
5,853,120 A 12/1998 McLeod et al.
5,881,884 A 3/1999 Podosek
5,921,398 A 7/1999 Carroll
5,957,294 A 9/1999 Kanter
5,967,406 A 10/1999 Moorman
5,979,746 A 11/1999 McLeod et al.
6,073,833 A 6/2000 Desrosiers et al.
6,098,874 A 8/2000 Tokarski
6,135,288 A 10/2000 Kim
6,168,027 B1 1/2001 Esser
6,189,780 B1 2/2001 Kanter
6,386,369 B2 * 5/2002 Yuhas et al. ..... 206/746
6,755,306 B2 * 6/2004 Maus ..... 206/774

FOREIGN PATENT DOCUMENTS

CA 786187 5/1968
DE 32 02 129 7/1983
DK 98049 5/1964
GB 2088830 A * 6/1982 ..... B65D 5/54

* cited by examiner

WRAPAROUND-STYLE SHIPPING CONTAINERS CONVERTIBLE TO DISPENSING OR DISPLAY CONTAINERS

BACKGROUND OF THE INVENTION

1. Field of the Invention

The present invention relates to shipping containers, in particular shipping containers that are fabricated at least in part from paper, paperboard and/or corrugated paperboard material. The present invention also relates to such containers that are convertible from a shipping configuration, to dispensing or display configurations.

2. The Prior Art

In stores which deal with dry goods that are sold in their own individual containers, such as grocery stores, a traditional method for placing the goods on display would be for store personnel to open the shipping containers in which the goods have been shipped from the supplier, and individually place each item on the shelf, and arrange them neatly for presentation. Typically, such containers were often structures dedicated solely to a shipping function, and when opened, were either destroyed, or resulted in an open-topped container not well suited for merchandising functions.

However, this process of individual removal of goods from a shipping container, and placement on shelves, is relatively costly to the store in terms of personnel effort, time, wages, etc. Therefore, it has become desirable to reduce costs in converting goods packaged for shipping into a suitable format for display and shopping.

This has resulted in the development of a variety of containers which are configured to be convertible from a shipping configuration, to a display configuration, which permits the converted container to be placed directly upon a shelf, or floor display, without having to remove the individual product items from the container. Typically, this is accomplished by providing the container with removable portions of the container that create apertures through which customers may then help themselves to the products within the converted container.

Such convertible containers represent a challenge in that they must be readily convertible into a form presentable to customers, while at the same time maintaining certain shipping performance characteristics, suitable for the shipment of non-self-supporting or even fragile products. In order to reduce cost in opening and placement of the converted container, the container should be hand-convertible, without the use of a knife or other implement. At the same time, it is desirable to provide a converted display container that is relatively free of unsightly or inconvenient rough edges or debris.

However, such prior art convertible containers often are either lacking in the necessary shipping performance characteristics or, in order to provide such performance, even after conversion, have structural elements that remain in position and make access to the product less convenient than desired. Other container constructions may achieve one or both of the performance or convenience goals, but at the expense of an inefficient or simply excessive use of container material.

It is accordingly desirable to provide a shipping container that is convertible to a display configuration, that has improved shipping performance characteristics, together with enhanced ease of conversion, and improved "shopability" for the consumer.

These and other desirable characteristics of the present invention will become apparent in view of the present specification and drawings.

SUMMARY OF THE INVENTION

The present invention is directed to a shipping container convertible to a display container, having a top, a bottom, first and second sides and first and second ends. The shipping container comprises, in part, an outer cover member formed from a first blank, including a bottom panel for forming the bottom of the shipping container. First and second side panels emanate from first and second opposing sides of the bottom panel. First and second end panels emanate from first and second opposing ends of the bottom panel.

The first and second end panels further include a bottom portion and a top portion. At least one of the first and second end panels further includes a zone of weakness enabling separation of the bottom portion from the top portion of the at least one of the first and second end panels. At least one reinforcement panel emanates from a top edge region of at least one of the first and second end panels, and is disposed in juxtaposed overlying relation to an inside surface of said at least one of the first and second end panels, and is affixed to an upper portion thereof.

At least one minor flap emanates from a side edge of said at least one of the first and second end panels, the at least one minor flap including a bottom portion and a top portion and a zone of weakness enabling facilitated separation of the bottom portion from the top portion of the at least one minor flap. A top panel is affixed to a top portion of at least one of the first and second end panels.

In a preferred embodiment of the invention, both of the first and second end panels include a zone of weakness enabling separation of the bottom portion from the top portion of both of the first and second end panels.

In one embodiment of the invention, the top panel is fabricated from a second blank of material discrete and separate from the first blank. In an alternative embodiment of the invention, the top panel is monolithically formed with and emanates from one of the first and second end panels. In this alternative embodiment, the top panel is joined to said one of the first and second end panels along a line of weakness, which enables manual separation of the top panel from said one of the first and second end panels.

The shipping container further preferably comprises at least one minor flap emanating from a side edge of the at least one reinforcement panel, and disposed so as to be juxtaposed to and in overlying relation to an inside surface of the at least one minor flap emanating from a side edge of said at least one of the first and second end panels.

In an embodiment of the invention, both of the first and second end panels include a zone of weakness enabling separation of the top and bottom portions of both of the first and second end panels. In this embodiment of the invention, the shipping container further comprises two reinforcement panels, emanating from top edge regions of each of the first and second end panels, and disposed in juxtaposed overlying relation to inside surfaces of the respective first and second end panels and affixed to upper portions thereof.

In an embodiment of the invention, the shipping container further comprises an aperture disposed in said end panel, for facilitating removal of the top panel.

Preferably, the zone of weakness is at least one of the following: a score line; a pull strip; at least one transverse line of perforations.

In an embodiment of the invention, the top panel further comprises at least one side flap, releasably adhered to a top portion of said at least one minor flap emanating from a side edge of said at least one of the first and second end panels, for enabling separation of the at least one side flap from the at least one minor flap, for further enabling separation of the top portion of said at least one minor flap from the bottom portion of the at least one minor flap.

DETAILED DESCRIPTION OF THE DRAWINGS

Figure 1:
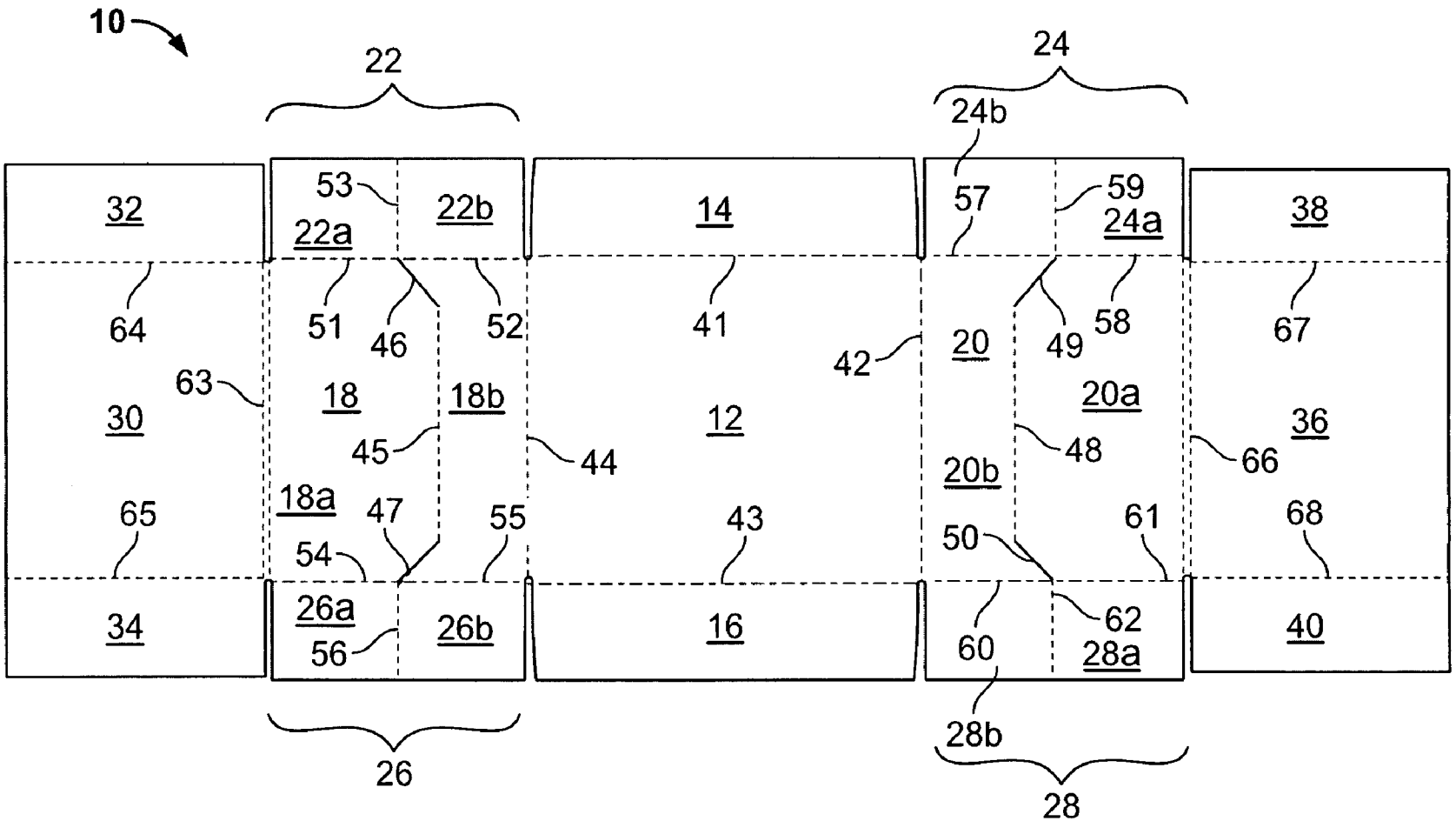
FIG. 1 is a plan view of a blank for a wrapper of a wraparound style container according to one embodiment of the invention.

While this invention is susceptible of embodiment in many different forms, there is shown in the drawings and will be described in detail, several specific embodiments, with the understanding that the present disclosure is to be considered as an exemplification of the principles of the invention and is not intended to limit the invention to the embodiments illustrated.

In accordance with the usual conventions regarding the illustration of blanks for paperboard or corrugated paperboard articles, and unless otherwise specified, broken or interrupted lines within the boundaries of a blank represent scores, perforations or other lines of weakness, and extended solid lines, on the interior of a blank represent cuts.

FIG. 1 is a plan view of a blank for a wrapper of a wraparound style container according to one embodiment of the invention. Blank 10 includes bottom panel 12; side panels 14, 16 and end panels 18 and 20, connected through fold lines 41, 42, 43, 44, respectively. End panels 18 and 20, in turn, are formed by upper end panels 18*a*, 20*a*, and lower end panels 18*b*, 20*b*, separated by score lines or lines of perforations 45 and 48, and cuts 46, 47 and 49, 50. End panel side flaps 22, 24, 26 and 28 are formed into end panel upper side flaps 22*a*, 24*a*, 26*a* and 28*a*; and end panel lower side flaps 22*b*, 24*b*, 26*b* and 28*b*, through fold lines (scores, lines of weakness) 51, 52; 54, 55; 57, 58; 60, 61 and perforations 53, 56, 59 and 62. Inner end panels 30 and 36 emanate from end panels 18 and 20, along double fold lines 63, 66, respectively. Inner end panel side flaps 32, 24; 38, 40 emanate along fold lines 64, 65; 67, 68, respectively.

Figure 2:
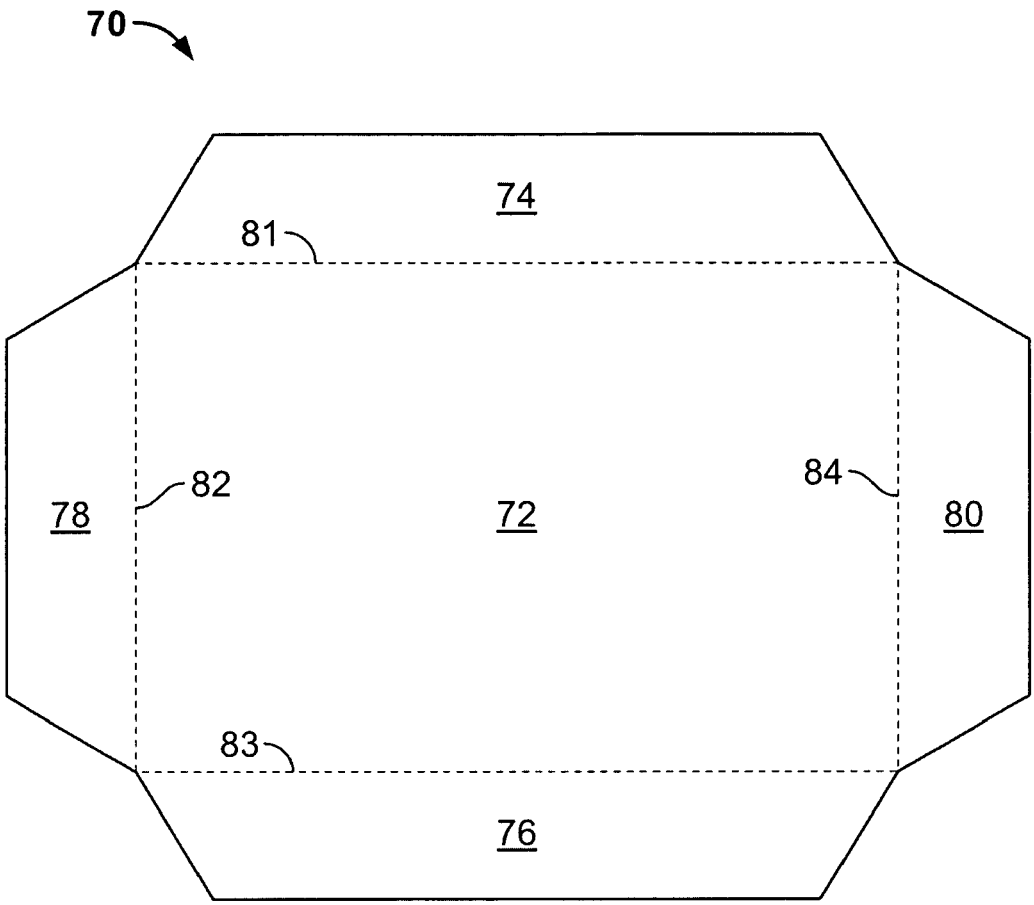
FIG. 2 is a plan view of a blank for a cap that may be used with several of the embodiments of the wraparound containers of the present invention.

FIG. 2 is a plan view of a blank for a cap that may be used with several of the embodiments of the wraparound containers of the present invention. Cap blank 70 includes center panel 72, side flaps 74, 76 (separated by fold lines 81, 83) and end flaps 78, 80 (separated by fold lines 82, 84).

Container 100 is formed in the following manner: in one preferred method, one blank 10 is drawn from a stack of blanks. The inner end panels 30, 36 are folded, about double fold lines 63, 36, until they overlie and are juxtaposed against the inside surfaces of end panels 18, 20, respectively.

Figure 1A:
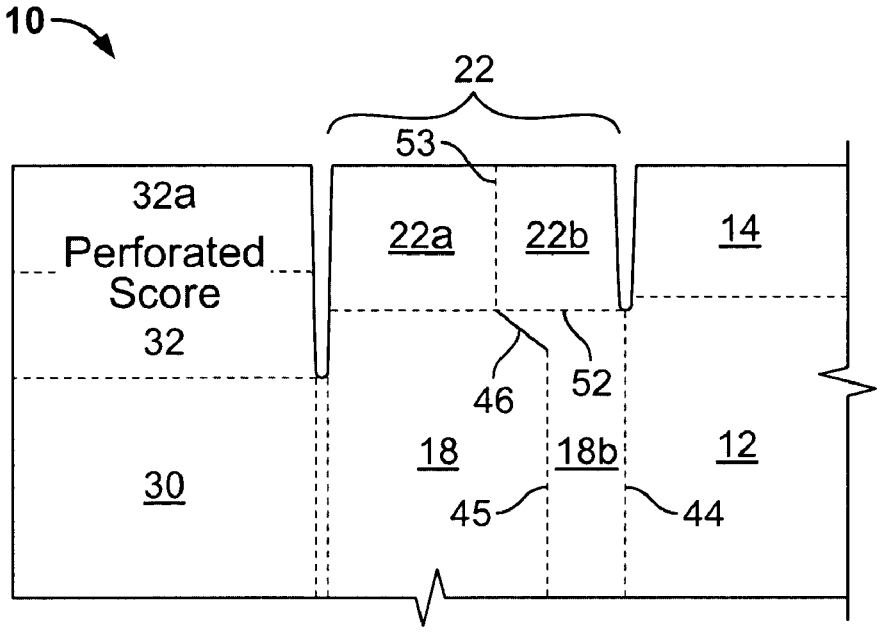
FIG. 1*a* is a fragmentary plan view of a blank for a wrapper that is a modification of the blank of FIG. 1.
Figure 1B:
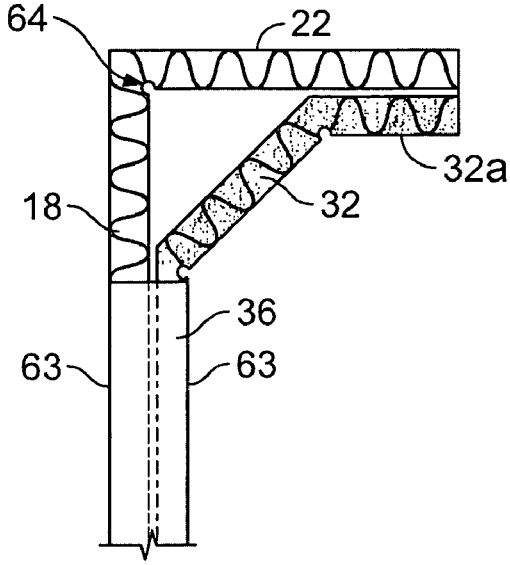
FIG. 1*b* is a fragmentary top view of a partially erected blank, according to the embodiment of FIG. 1*a*.

Prior to this step, adhesive is applied to either inner end panels 30, 36, or to upper end panels 18*a*, 20*a*, so that when folded over, lower end panels 18*b*, 20*b* are not affixed to adjacent portions of panels 30, 36. Inner end panel side flaps 32, 34, 38 and 40 may be adhesively affixed to end panel upper side flaps 22*a*, 24*a*, 26*a* and 28*a*, but not to end panel lower side flaps 22*b*, 24*b*, 26*b* and 28*b*. Alternatively, inner end flaps 32, 34, 38, 40 can also be folded at an angle (e.g., panel 32 including a sub-panel 32*a*, as shown in FIGS. 1*a* and 1*b*) providing a triangular corner described by end panels 18 and 30 or 30 and 36 being parallel to each other, outside end panels 22, 26, 24 and 28 being (at 90 degrees) perpendicular to the side panels 18, 30, 48 and 36, but inner end flaps 22, 24, 26 and 28 being at some pre-defined angle describing a triangular cross-section.

At this point in the process (if not performed earlier), the goods to be contained are positioned on blank 10, centered over bottom panel 12. End panels 18 and 20 (together with respective inner panels 30, 36) are folded up perpendicular to bottom panel 12, while end panel side flaps 22, 32; 26, 34; 24, 38; and 28, 40, are folded perpendicular to end panels 18, 30; 20, 26. Side panels 14, 16 are folded up perpendicular to bottom panel 12, and adhesively adhered to end panel lower side flaps 22*b*, 24*b*, 26*b* and 28*b*. Cap blank 70 is then positioned over the articulated and glued wrapper (with goods inside). End flaps 78, 80 are folded down and adhesively affixed to upper end panels 18*a*, 20*a*. Side flaps 74, 76 are preferably folded down and only spot adhered to end panel upper side flaps 22*a*, 24*a*, 26*a*, 28*a*, so that with a relatively minimal amount of effort, side flaps 74, 76 can be pulled up away from end panel upper side flaps 22*a*, 24*a*, 26*a*, 28*a*, with relatively little damage thereto.

Figure 3:
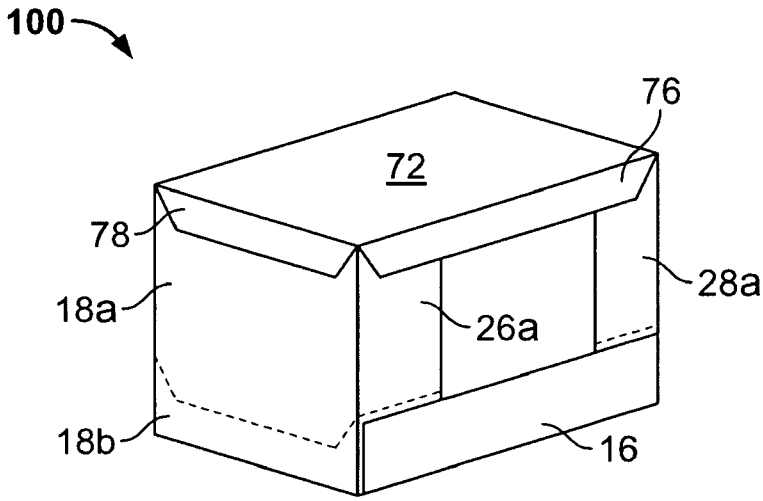
FIG. 3 is a perspective view of a container, formed from the wrapper of FIG. 1, and the cap of FIG. 2.
Figure 4:
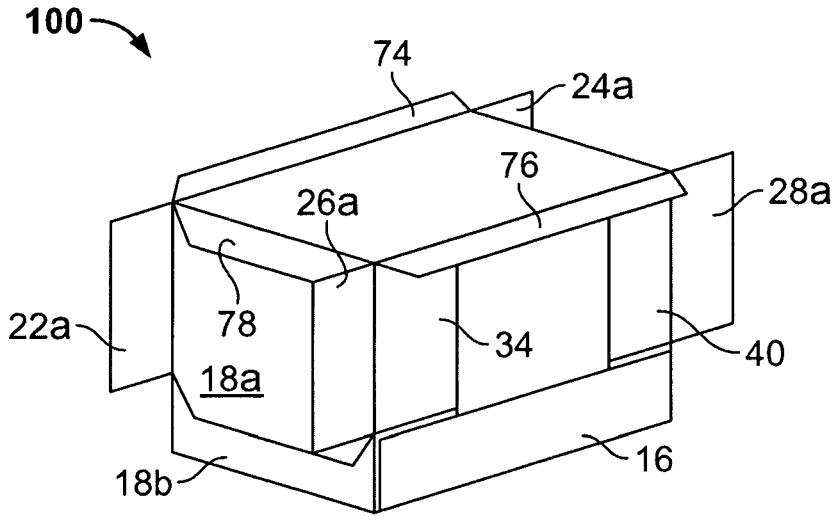
FIG. 4 is a perspective view of the container of FIG. 3, with two of the cap flaps pulled up, and the frangible portions of the outer side panels pulled away.
Figure 5:
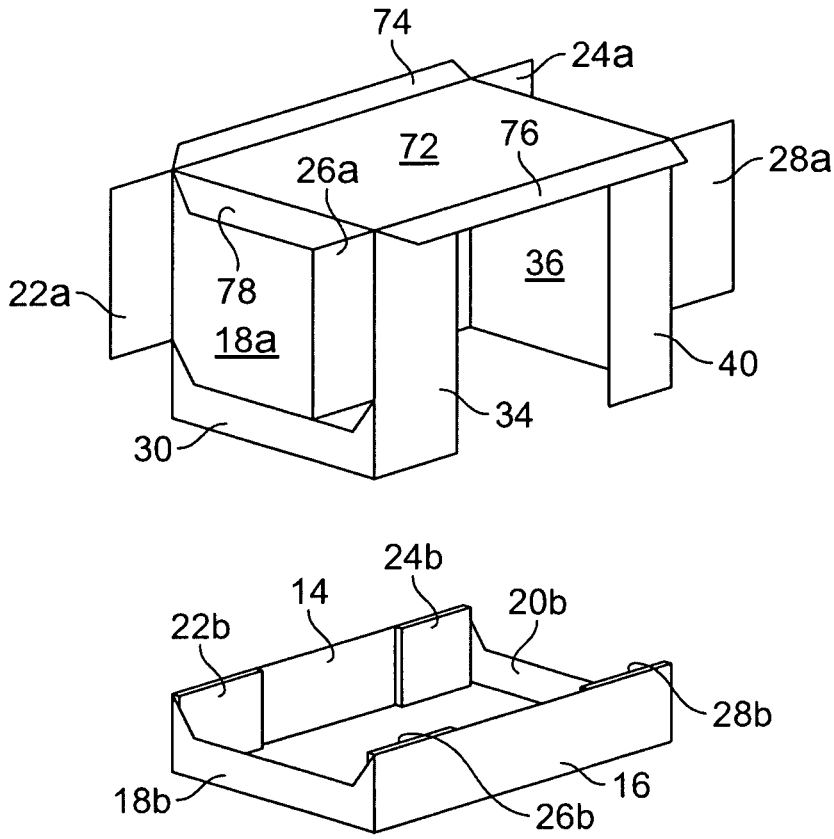
FIG. 5 is an exploded perspective view of the container of FIGS. 3 and 4, showing the upper portion of the wrapper separated from the remaining tray portion.

Once the folding and gluing process has been completed, the result is a container 100, as shown in a perspective view in FIG. 3. The process of opening container 100 begins, as shown in FIG. 4, by pulling up cap side flaps 74, 76, which as mentioned are only lightly adhered to end panel upper side flaps 22*a*, 24*a*, 26*a*, 28*a*. End panel upper side flaps 22*a*, 24*a*, 26*a*, 28*a* are then torn out, along perforation lines 53, 59, 56 and 62, respectively, also as shown in FIG. 4. Next, upper end panels 18*a*, 20*a*, are separated from lower end panels 18*b*, 20*b*, either by joining cuts 46, 47 and 49, 50 by knife cutting along score lines 45, 48 (or if lines 45, 48 are perforation lines, breaking the perforations). The connections between upper end panels 18*a*, 20*a*, and lower end panels 18*b*, 20*b* being the only structural connection, keeping the upper portion of the wrapper 10 (and cap 70) connected to the lower portion of wrapper 10, the upper portion of the wrapper becomes readily separable from the lower, remaining tray portion of wrapper 10, as shown in FIG. 5.

Figure 6:
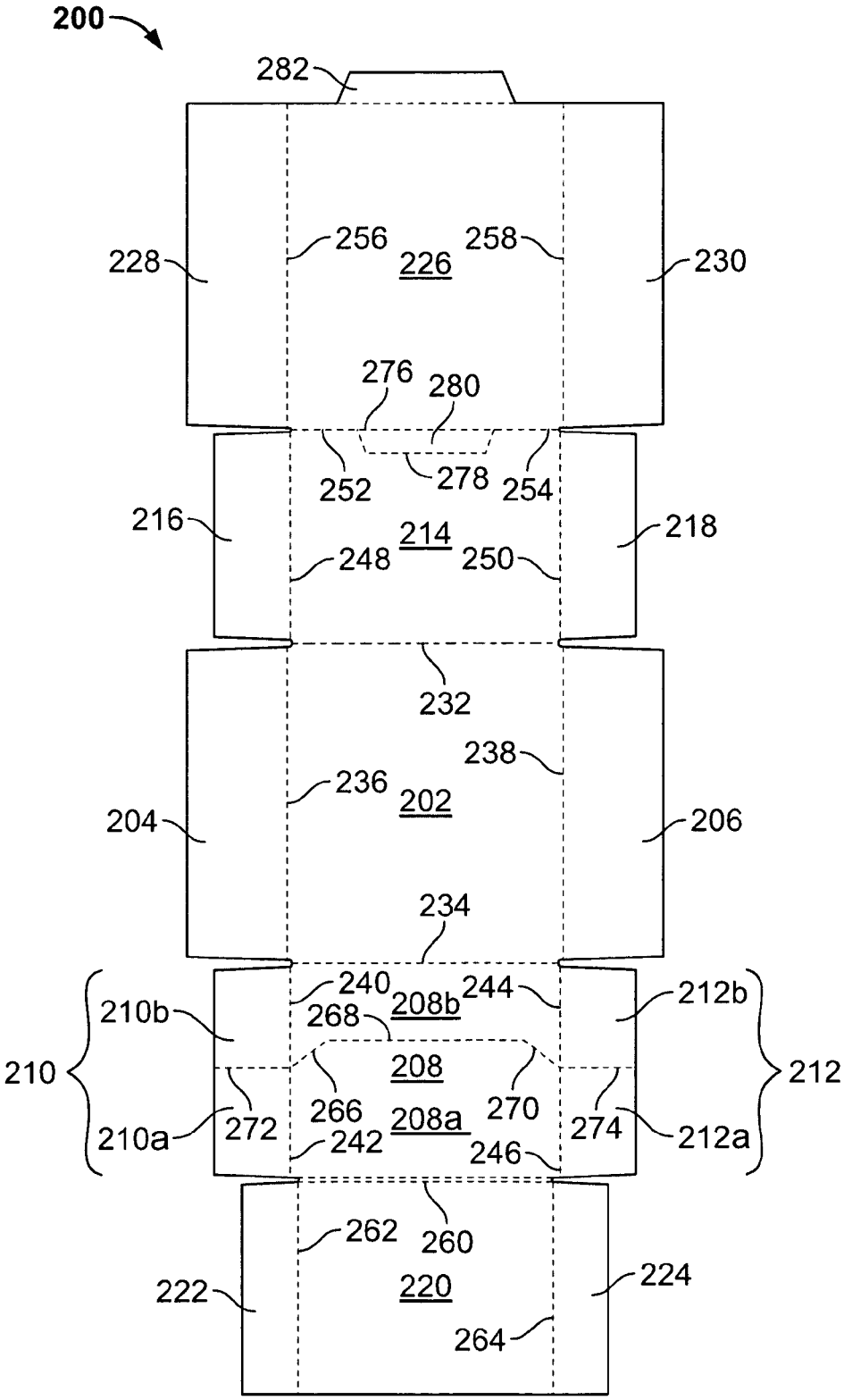
FIG. 6 is a plan view of a wrapper for a wraparound style container according to another embodiment of the present invention.

FIG. 6 is a plan view of a wrapper for a wraparound style container according to another embodiment of the present invention, in which the entire container is formed from a single blank. Blank 200 includes bottom panel 202; side panels 204, 206; front panel 208; front side panels 210, 212; rear panel 214; rear side panels 216, 218; inner front panel 220; inner front panel side flaps 222, 224; top panel 226 and top panel side flaps 228, 230. Blank 200 also includes fold lines 232, 234, 236, 238, 240, 242, 244, 246, 248, 250, 256, 258, 260 (double fold line), 262 and 264, and 276. Perforations 266, 268, 270 divide front panel 208 into upper front panel 208*a* and lower front panel 208*b*. Perforation 272 divides front side panel 210 into front side upper panel 210*a* and front side lower panel 210*b*. Perforation 274 divides front side panel 212 into front side upper panel 212 into front side upper panel 212*a* and front side lower panel 212*b*. Perforations 252, 278 and 254 enable top panel 226 to be separated from rear panel 214. Blank 200 also includes glue flap 282.

Figure 6A:
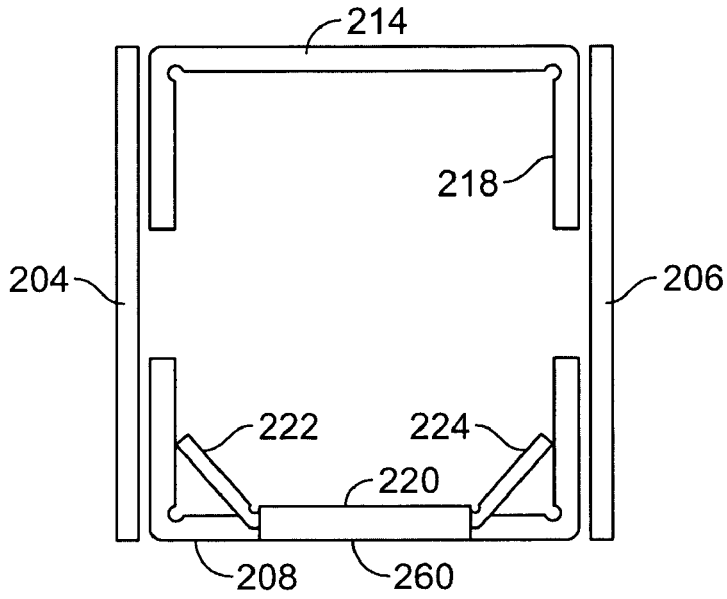
FIG. 6*a* is a top plan view of a wrapper for a wraparound style container, according to a modification of the embodiment of FIG. 6.

Formation of container 201 is accomplished by withdrawing a blank 200 from a stack of blanks. The goods to be packaged may be, at this point, positioned over bottom panel 202, or shortly thereafter. Inner front panel 220 is folded over to the inside of front panel 208. Inner front panel 220 is adhered to upper front panel 208*a*, while inner front panel side flaps 222, 224 are not adhered to front side upper panels 210*a* and 212*a*. Front panels 208 and 220 are folded up perpendicular to bottom panel 202, and rear panel 214 is likewise folded up perpendicular to bottom panel 202. Panels 210, 222; 212, 224 are folded perpendicular to front panels 208, 220, while rear side panels 216, 218 are folded perpendicular to rear panel 214. Side panels 204, 206 are then folded up perpendicular to bottom panel 202, and adhered to front side lower panels 210*b*, 212*b*, and rear side panels 216, 218. Alternatively, as shown in FIG. 6*a*, inner panels 222, 224 can be of a proportion and set at or erected at an angle to panels 220 and 208 while panels 210 and 212 are disposed perpendicular to panel 208, upon erection of blank 200.

Figure 7:
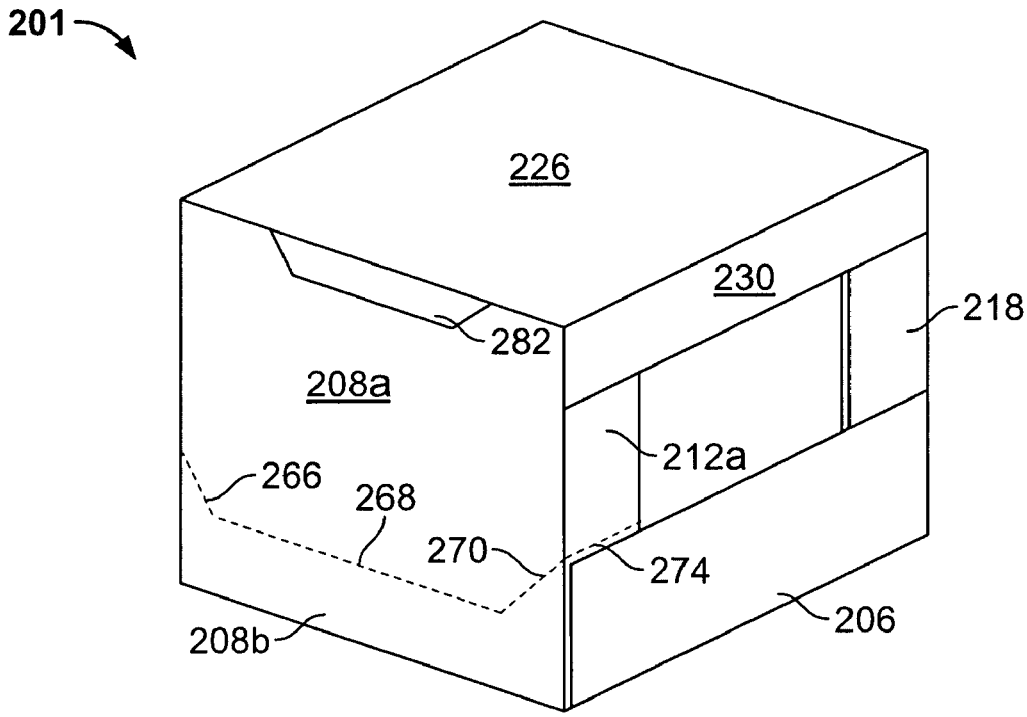
FIG. 7 is a perspective view of a container, formed from the wrapper of FIG. 6.

While the goods to be packaged preferably have been positioned on blank 200 long before this stage in the articulation process, at this point container 201 comprises an open-topped container, into which the goods may be lowered. Thereafter, the container is closed by folding top panel 226 over the upper opening, folding down top panel side flaps 228, 230 and lightly ("spot") adhering then to front side upper panels 210*a* and 212*a*, and to rear side panels 216, 218. Glue flap 282 is folded down over upper front panel 208*a* and adhered thereto, resulting in container 201, as shown in FIG. 7 in a perspective view.

Figure 8:
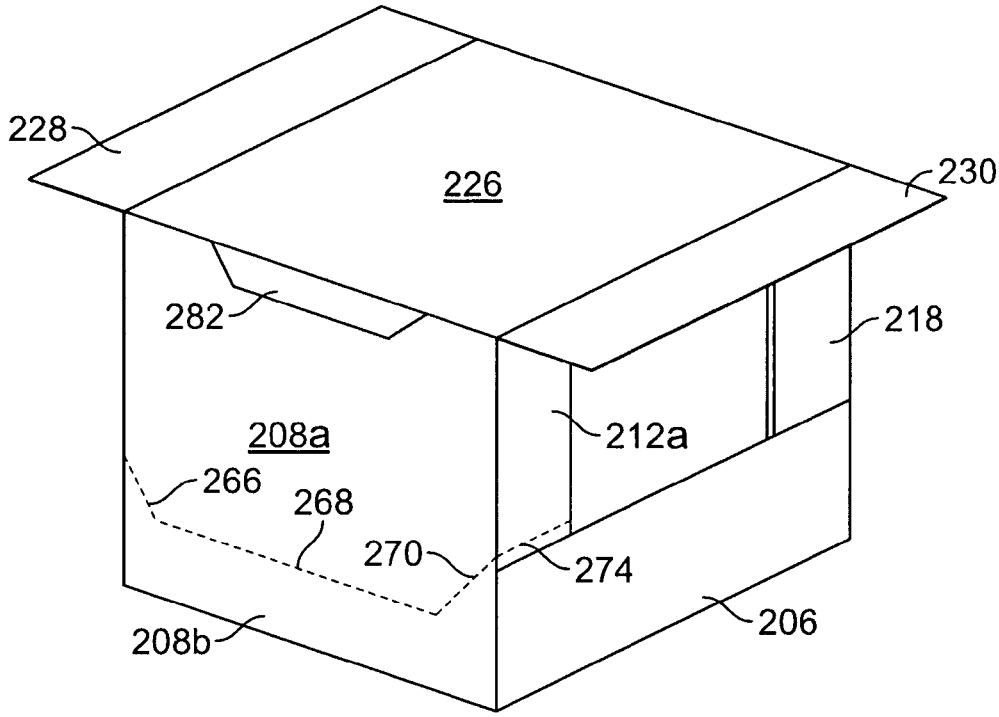
FIG. 8 is a perspective view of the container of FIG. 7, with the top side flaps pulled up, toward separation of the upper portion of the wrapper.
Figure 9:
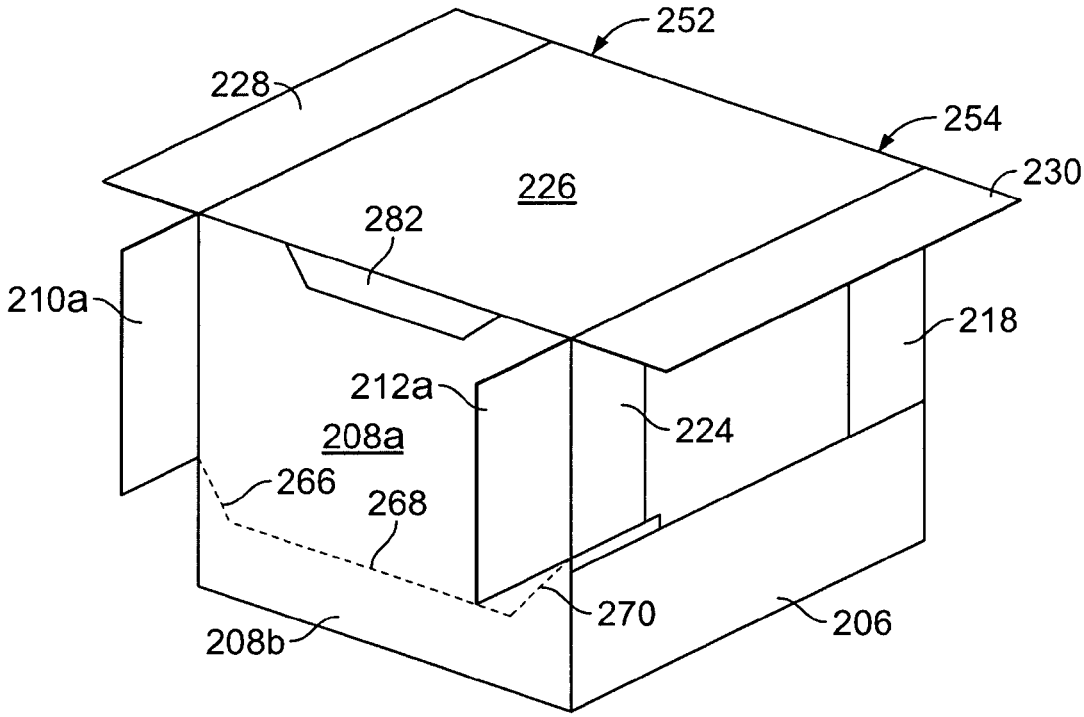
FIG. 9 is a perspective view of the container of FIGS. 7 and 8, in which the frangible portions of the outer side panels have been pulled away.
Figure 10:
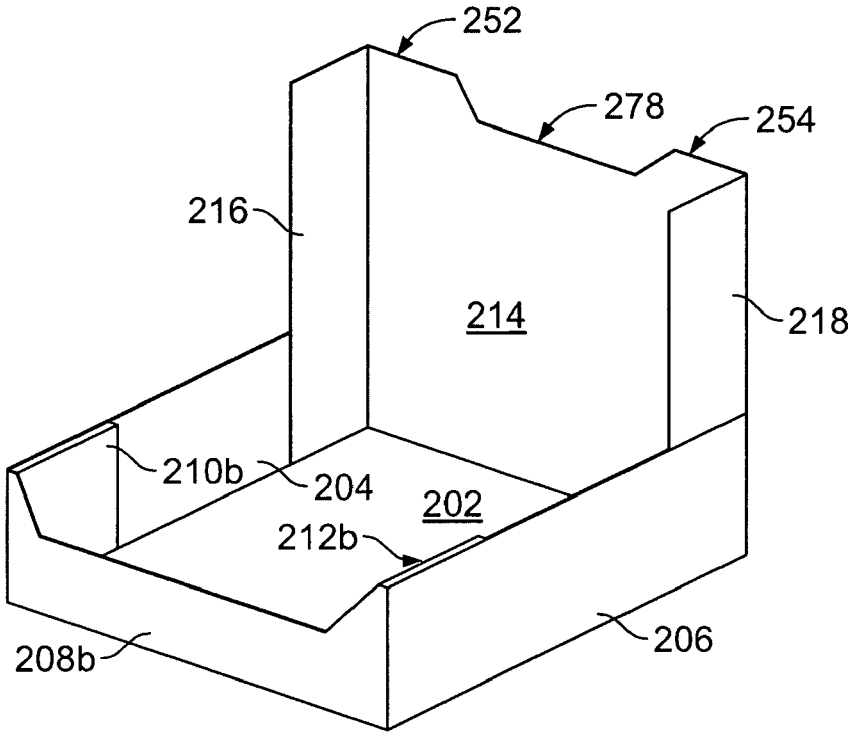
FIG. 10 is a perspective view of the display tray remaining, once the upper portion of the wrapper has been removed.

The process of opening container 201 begins, as shown in FIG. 8, by pulling up top panel side flaps 228, 230, which as mentioned are only lightly adhered to front side upper flaps 210*a*, 212*a*, and rear side panels 216, 218. Front side upper flaps 210*a*, 212*a* are then torn out, along perforation lines 272, 274, respectively, as shown in FIG. 9. Next, upper front panel 208*a* is separated from lower front panels 208*b*, by breaking or knife cutting along perforations 266, 268, 270. Top panel 226 is separated from rear panel 214, by tearing along perforations 252, 278, and 254. Thus, the upper portion of wrapper 200 can be removed, leaving a display tray having a remaining rear panel, as shown in FIG. 10.

Figure 11:
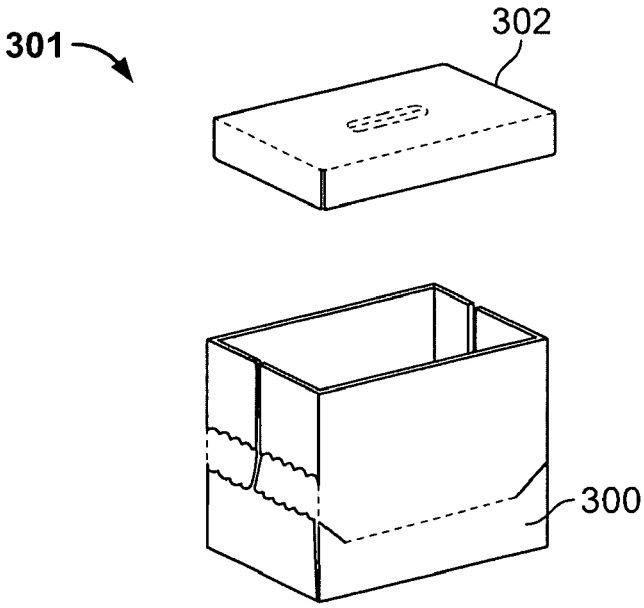
FIG. 11 is a perspective view of a wraparound style container according to another embodiment of the present invention.
Figure 12:
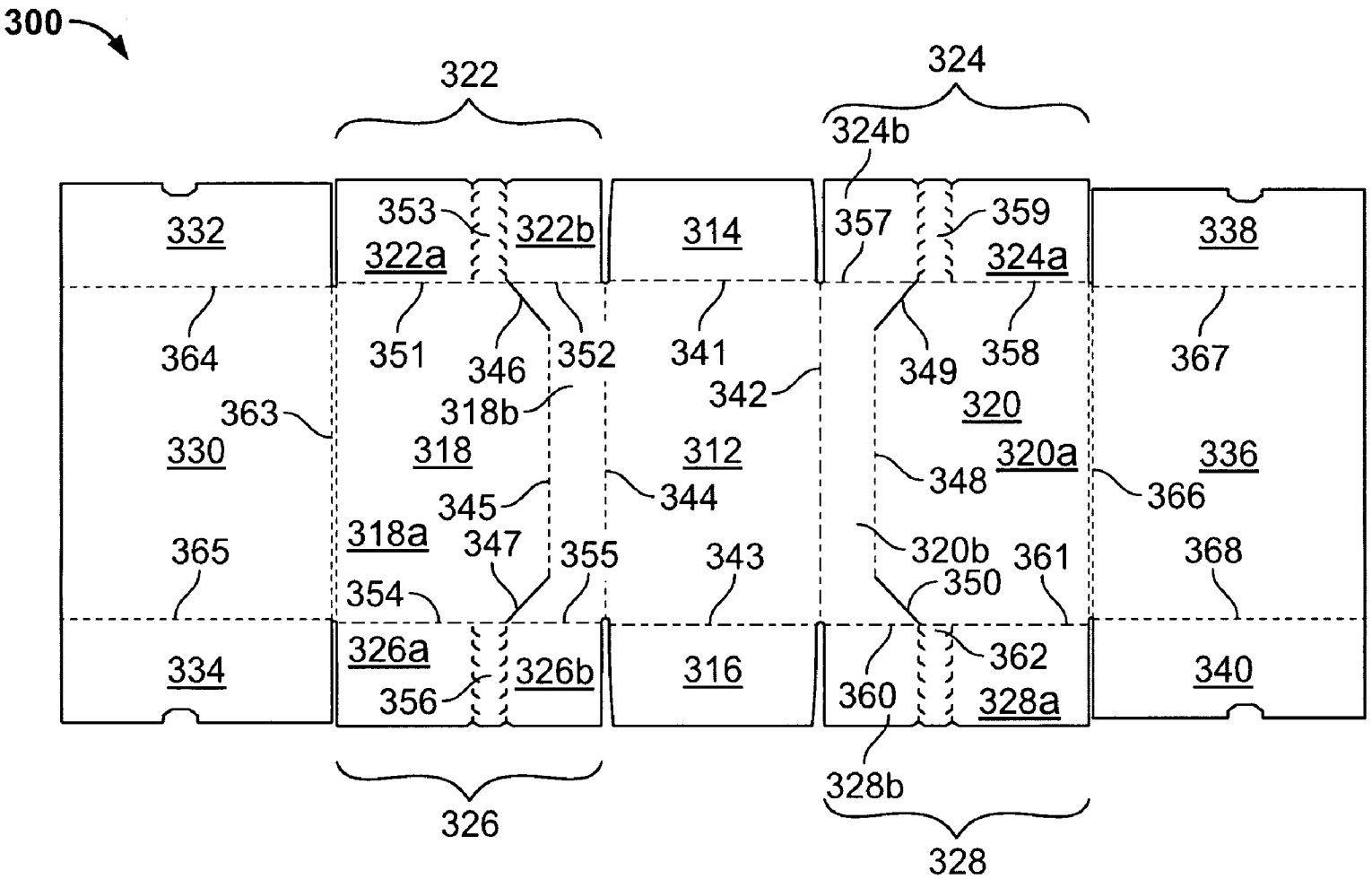
FIG. 12 is a plan view of a blank for the wrapper of the container of FIG. 11.

FIG. 11 is a perspective view of a wraparound style container 301 according to another embodiment of the present invention, wherein the container employs a wrapper 300 and a cap 302. FIG. 12 is a plan view of a blank for the wrapper 300 of the container 301 of FIG. 11. Blank 300 includes bottom panel 312; side panels 314, 316 and end panels 318 and 320, connected through fold lines 341, 342, 343, 344, respectively. End panels 318 and 320, in turn, are formed by upper end panels 318*a*, 320*a*, and lower end panels 318*b*, 320*b*, separated by score lines or lines of perforations 345 and 348, and cuts 346, 347 and 349, 350. End panel side flaps 322, 324, 326 and 328 are formed into end panel upper side flaps 322*a*, 324*a*, 326*a* and 328*a*; and end panel lower side flaps 322*b*, 324*b*, 326*b* and 328*b*, through fold lines (scores, lines of weakness) 351, 352; 354, 355; 357, 358; 360, 361 and pull strips (formed by zipper cuts) 353, 356, 359 and 362. Inner end panels 330 and 336 emanate from end panels 318 and 320, along double fold lines 363, 366, respectively. Inner end panel side flaps 332, 334; 338, 340 emanate along fold lines 364, 365; 367, 368, respectively.

Figure 13:
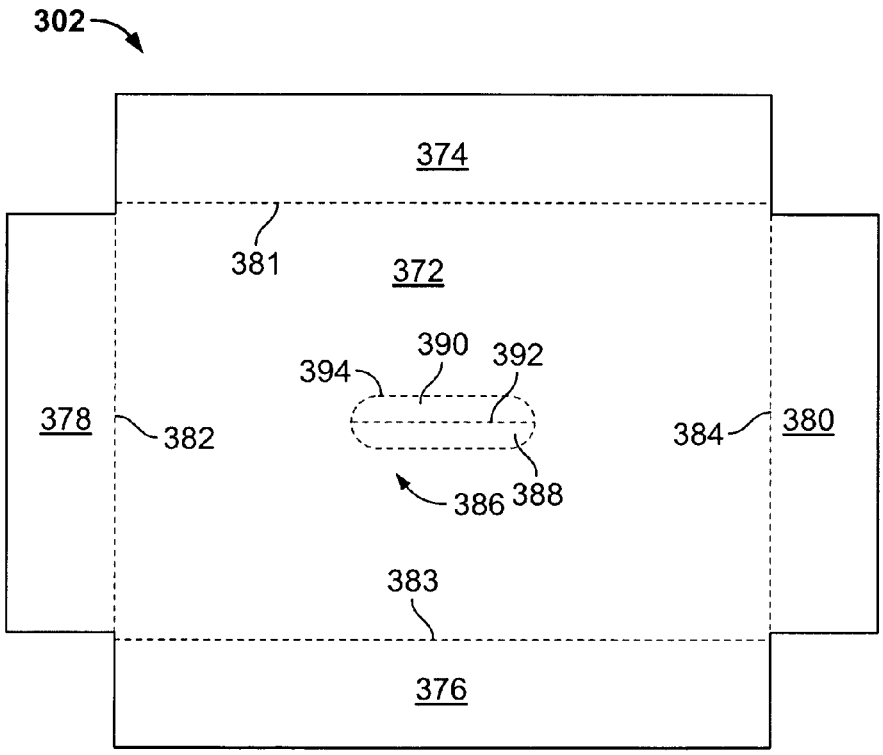
FIG. 13 is a plan view of a blank for the cap of the container of FIG. 11.

FIG. 13 is a plan view of a blank 302 for a cap that may be used with several of the embodiments of the wraparound containers of the present invention, including, in particular, the embodiment created from blank 300. Cap blank 302 includes center panel 372, side flaps 374, 376 (separated by fold lines 381, 383) and end flaps 378, 380 (separated by fold lines 382, 384). Blank 302 also includes a hand opening area 386, including opening flaps 388, 390, formed by transverse slit 392, and oval cut-perforation 394.

Figure 14:
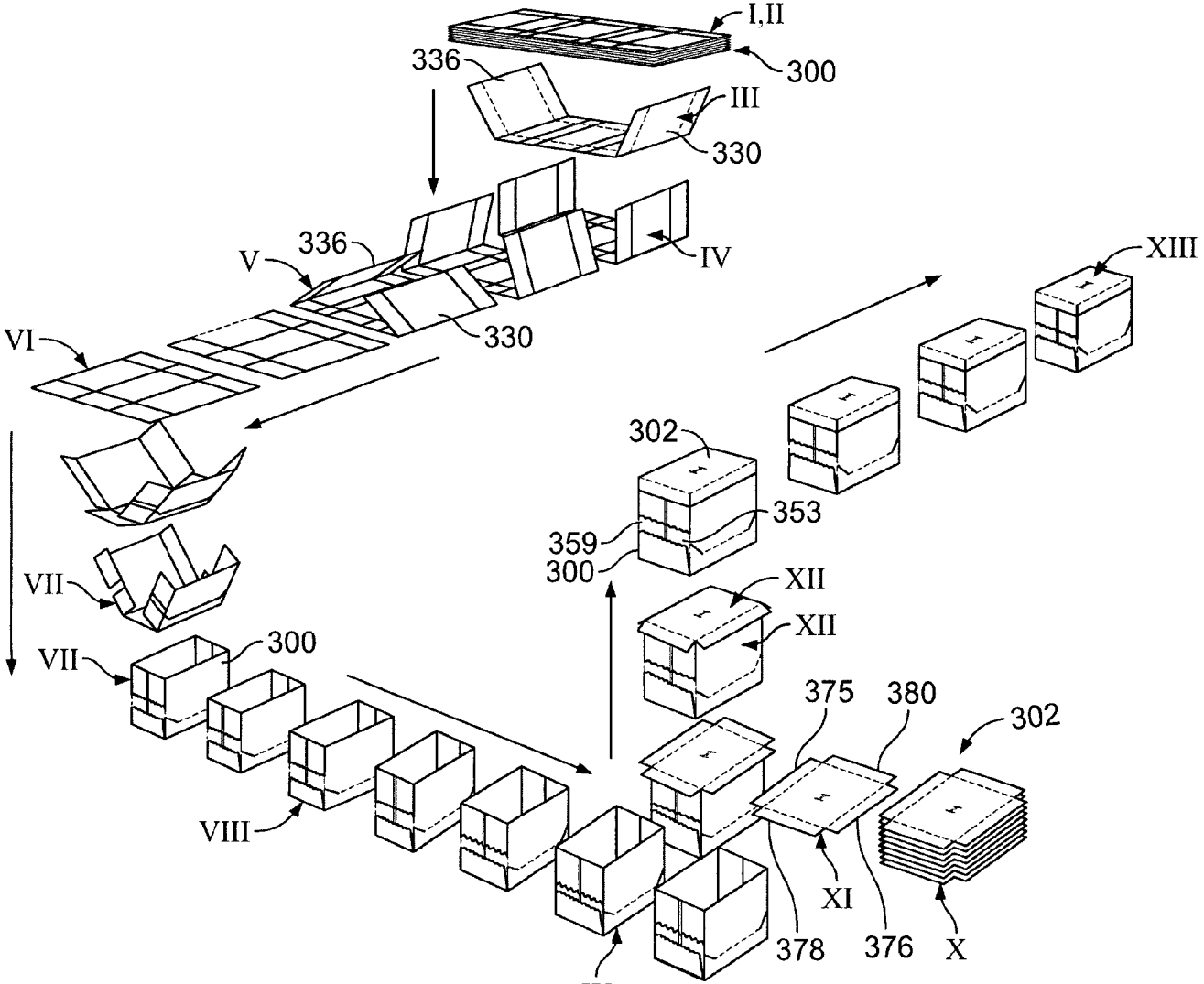
FIG. 14 illustrates the steps in the process for forming the container configured from the blanks of FIGS. 11 and 12.

FIG. 14 illustrates the steps in a preferred process for forming containers 301. The actual formation machinery are not shown. However, formation machinery of the type for forming wraparound container blanks are generally known in the prior art, and may be modified by one of ordinary skill in the art, having had the present disclosure before them. Accordingly, for ease of illustration of the process, the machinery elements have been omitted from the illustration.

The die cut wrapper blanks 300 are stacked in a hopper (step I) Individual blanks 300 are drawn from the stack (step II). One blank 300 is drawn from the hopper and formed into a U-shape (step III). As the formed blank 300 is advanced along the formation path, adhesive is applied to inner panels 330, 336 (step IV). The U-shaped blank 300 is further folded until the inner panels 330, 336 are adhered to the exterior panels, specifically panels 318*a*, 320*a* (step V). lower end panels 318*b*, 320*b* are not affixed to adjacent portions of panels 330, 336. Inner end panel side flaps 332, 334, 338 and 340 may be adhesively affixed to end panel upper side flaps 322*a*, 324*a*, 326*a* and 328*a*, but not to end panel lower side flaps 322*b*, 324*b*, 326*b* and 328*b*. The folded blank, now having double-thickness side panels, is (preferably) compressed, and moved into a tray-forming section of the formation machinery (step VI).

The blank 300 is now formed into a tray (step VII). During these steps in the process (if not performed earlier), the goods to be contained may positioned on blank 300, centered over bottom panel 312. End panels 318 and 320 (together with respective inner panels 330, 336) are folded up perpendicular to bottom panel 312, while end panel side flaps 322, 332; 326, 334; 324, 338; and 328, 340, are folded perpendicular to end panels 318, 330; 320, 326. Side panels 314, 316 are folded up perpendicular to bottom panel 312, and adhesively adhered to end panel lower side flaps 322*b*, 324*b*, 326*b* and 328*b*. Alternatively, once the tray has been fully formed, the goods may be inserted into the formed tray by a drop packing section, such as are known in the art (step VIII).

The tray base formed from blank 300, with product inside, is then advanced to a lidder section (step IX). A plurality of cap blanks 302 are stacked in a hopper (step X). Successive cap blanks 302 are positioned over the articulated and glued wrappers (step XI). As a tray portion (articulated blank 300 plus product) is raised, flaps 374, 376, 378 and 380 are folded down and adhesively affixed to panels 318*a*, 320*a* and panels 322*a*, 324*a*, 326*a* and 328*a* (step XII). The sealed containers are then conveyed to another location for placement on pallets for shipment (step XIII).

Figure 15:
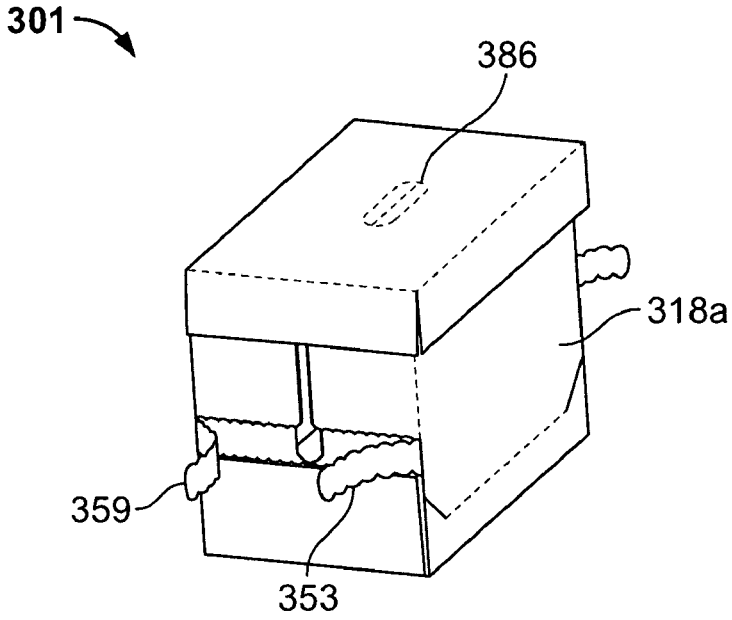
FIG. 15 is a perspective view of the container of FIG. 11, with the zipper pull strips partially pulled away.
Figure 16:
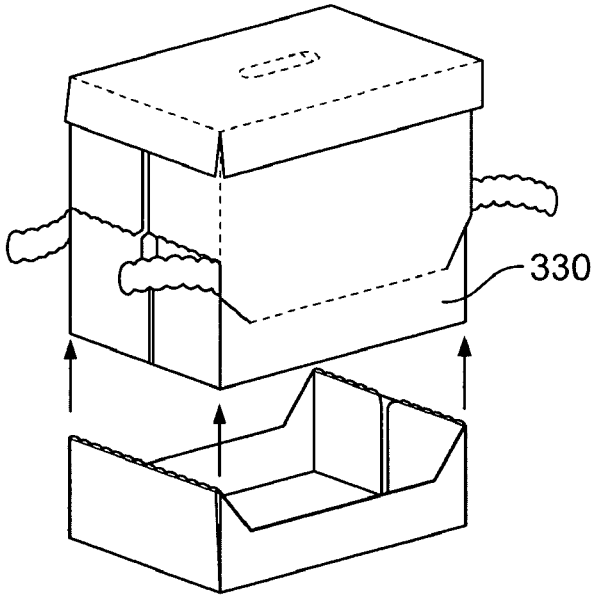
FIG. 16 is a perspective exploded view of the container of FIGS. 11 and 15, showing how the upper portion of the wrapper and cap are removed, upon full removal of the zipper pulls.
Figure 17:
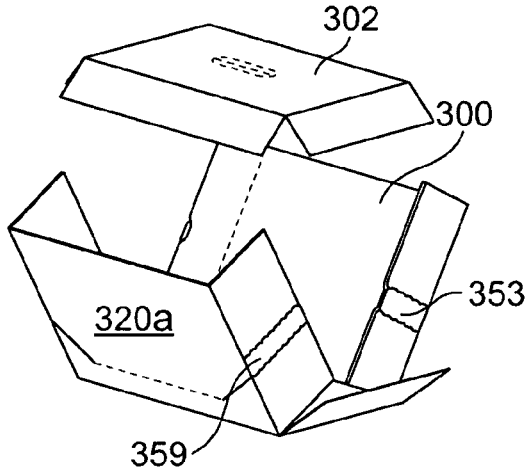
FIG. 17 is a perspective exploded view of the partially articulated wrapper and cap forming the container of FIGS. 11–16.
Figure 18:
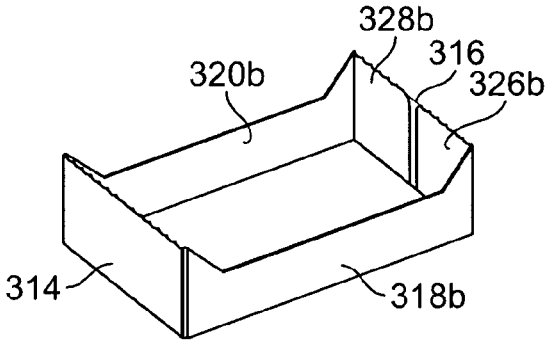
FIG. 18 is a perspective view of the tray remaining, after removal of the cap and upper portion of the wrapper, from the container of FIGS. 11–17.
Figure 19:
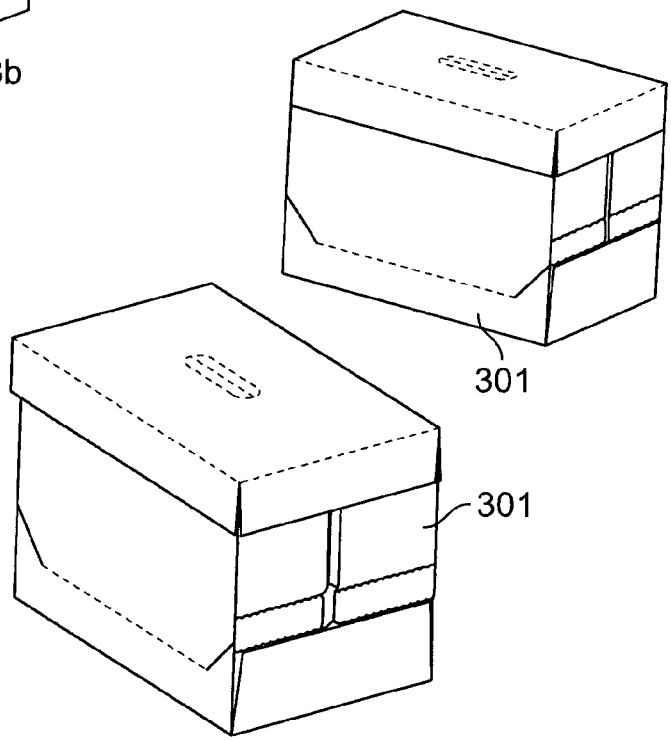
FIG. 19 illustrates two perspective views of the container of FIGS. 11–18.

Once the folding and gluing process has been completed, the result is a container 301, as shown in a perspective view in FIG. 19. The process of opening container 301 begins, as shown in FIG. 15, by pulling out the zipper pull strips 353, 359 (and 356, 362, on the reverse side of container 301). Next, upper end panels 318*a*, 320*a*, are separated from lower end panels 318*b*, 320*b*, either by joining cuts 346, 347 and 349, 350 by knife cutting along score lines 345, 348 (or if lines 345, 348 are perforation lines, breaking the perforations). The connections between upper end panels 318*a*, 320*a*, and lower end panels 318*b*, 320*b* being the only structural connection, keeping the upper portion of the wrapper 300 (and cap 302) connected to the lower portion of wrapper 300, the upper portion of the wrapper becomes readily separable from the lower, remaining tray portion of wrapper 300, as shown in FIG. 16.

Figure 20:
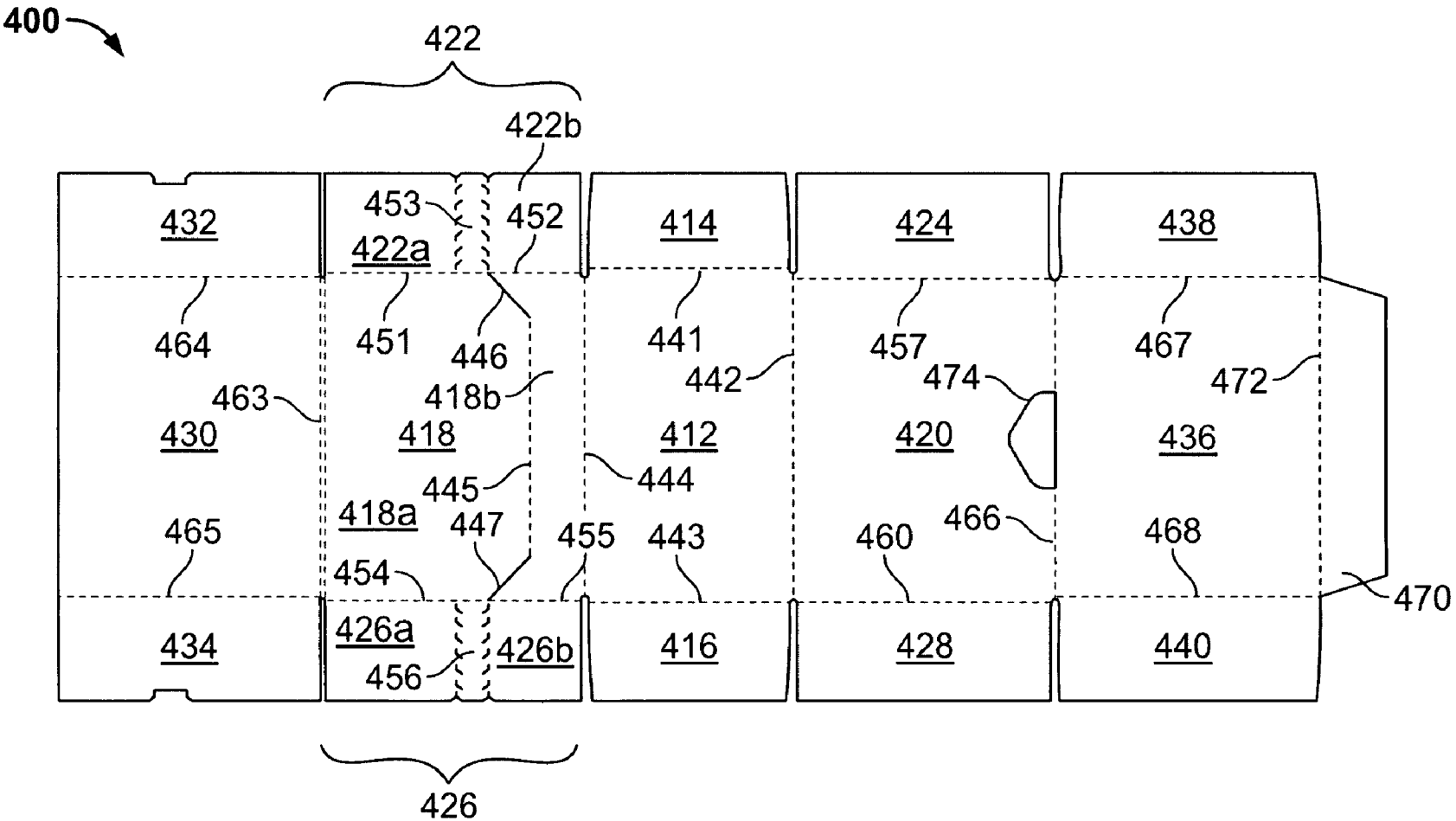
FIG. 20 is a plan view of a blank for a wrapper for a wraparound style container according to another embodiment of the invention.

FIG. 20 is a plan view of a blank for wrapper 400 of container 401 of a further alternative embodiment of the invention. Blank 400 includes bottom panel 412; side panels 414, 416 and end panels 418 and 420, connected through fold lines 441, 442, 443, 444, respectively. End panel 418, in turn, is formed by upper end panel 418*a* and lower end panel 418*b* separated by score line or line of perforations 445 and cuts 446, 447. End panel side flaps 422 and 426 are formed into end panel upper side flaps 422*a* and 426*a*; and end panel lower side flaps 422*b* and 426*b*, through fold lines (scores, lines of weakness) 451, 452; 454, 455 and pull strips (formed by zipper cuts) 453, 456. End panel side flaps 424, 428 are connected to end panel 420 via fold lines 457, 460. Inner end panel 430 emanates from end panel 418 along double fold line 463. Inner end panel side flaps 432, 424 emanate along fold lines 464, 465, respectively. Top panel 436 emanates from end panel 420, along perforation line 466 (divided by generally triangular cutout 474). Top panel side flaps 438, 440 emanate from top panel 436 along fold lines 467, 468. Glue flap 470 emanates from top panel 436 along fold line 472.

Figure 21:
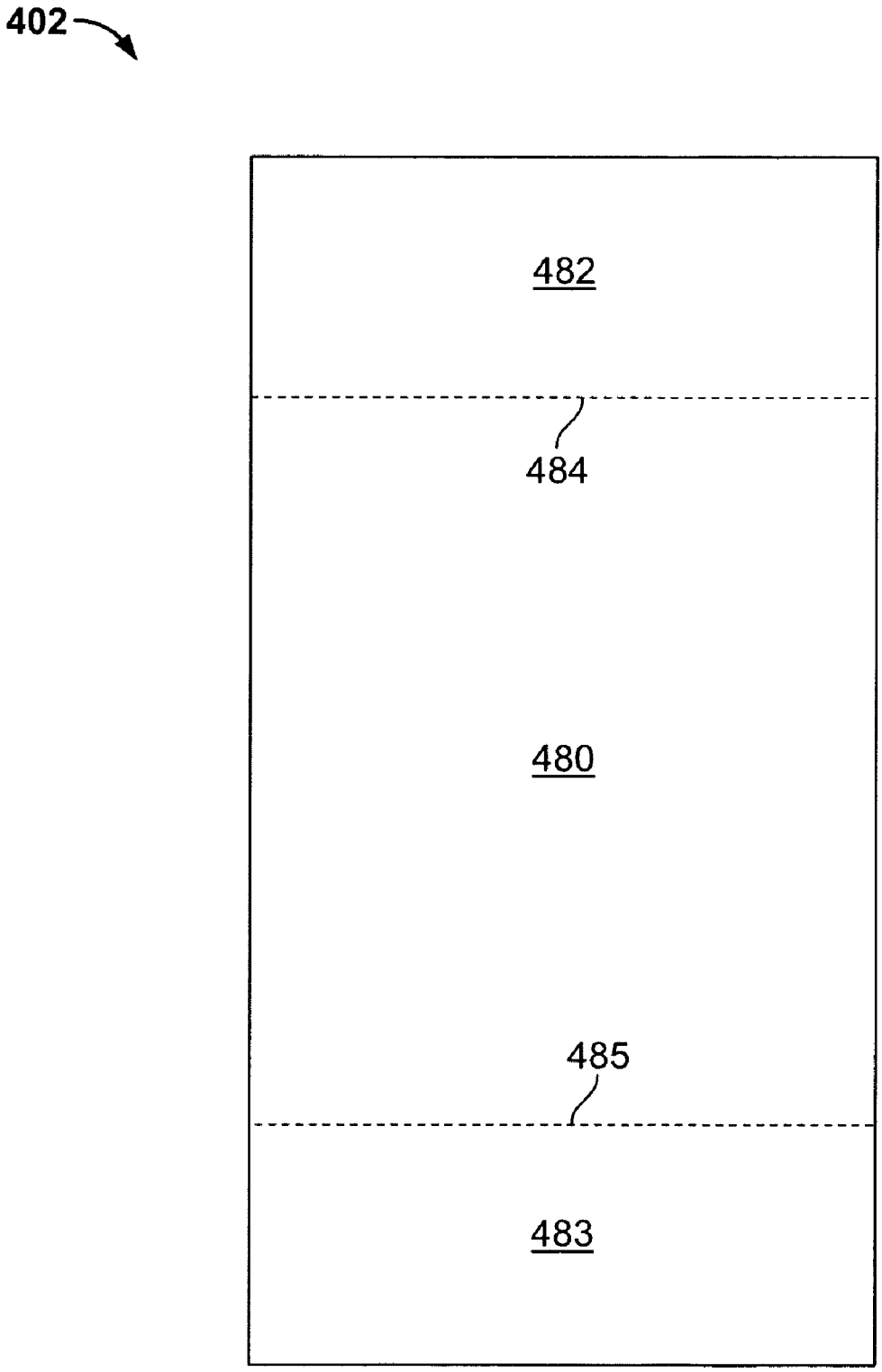
FIG. 21 is a plan view of the blank for a divider that may be used with the wrapper of FIG. 20.

Container 401 may also include, if desired, an internal divider (shown in FIG. 21) formed from blank 402, which includes center panel 480, and attachment flaps 482, 483, connected to panel 480 via fold lines 484, 485.

Figure 22:
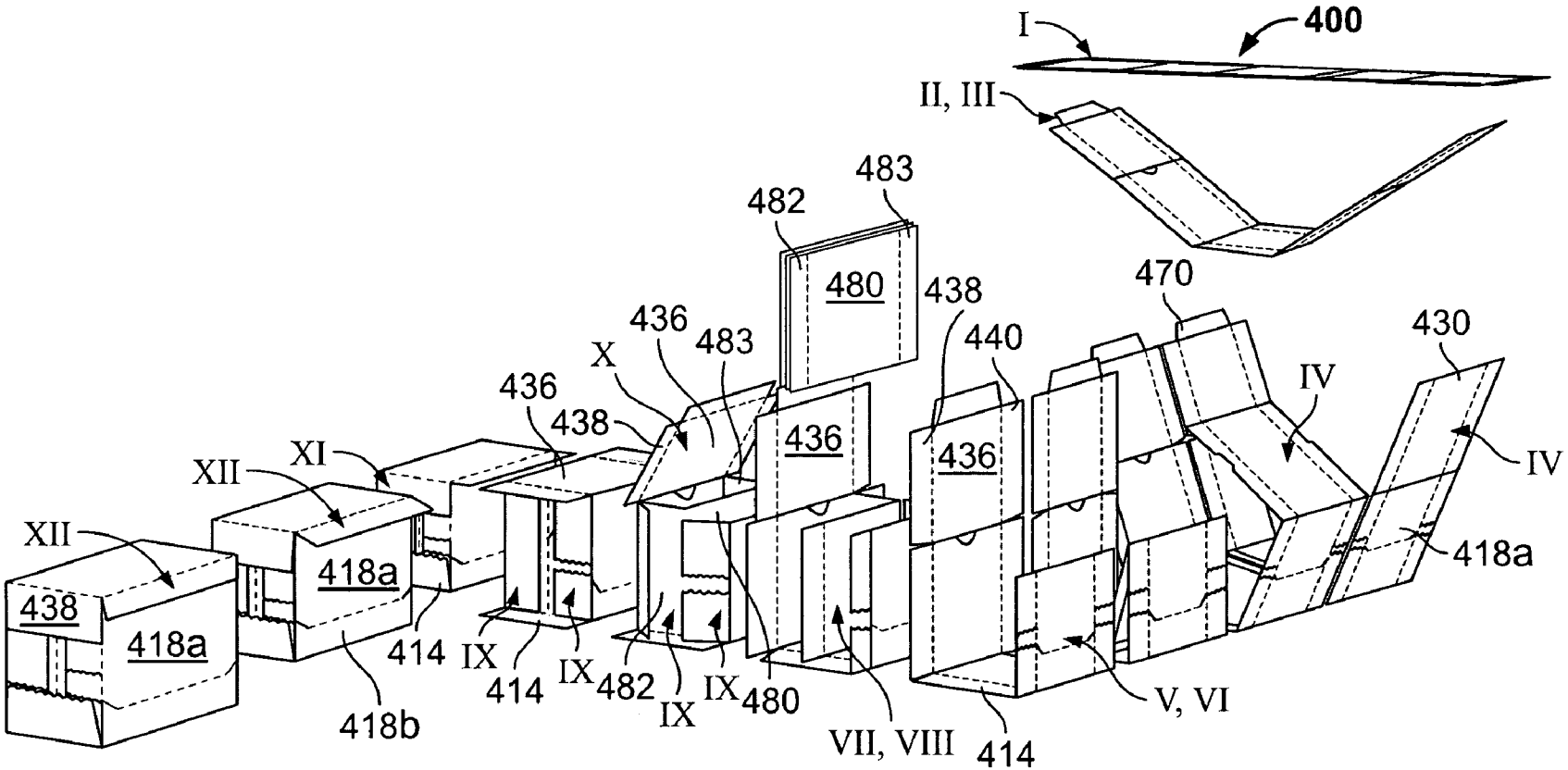
FIG. 22 illustrates the steps in the articulation and formation of the container formed from the wrapper and divider blanks of FIGS. 20–21, respectively.

FIG. 22 illustrates the steps in a preferred process for forming containers 401. The actual formation machinery are not shown. However, formation machinery of the type for forming wraparound container blanks are generally known in the prior art, and may be modified by one of ordinary skill in the art, having had the present disclosure before them. Accordingly, for ease of illustration of the process, the machinery elements have been omitted from the illustration.

The die cut wrapper blanks 400 are stacked in a hopper (step I). Individual blanks 400 are drawn successively from the stack (step II). One blank 400 is drawn from the hopper and formed into a V-shape (step III). As the formed blank 400 is advanced along the formation path, adhesive is applied to inner panel 430 (step IV). Blank 400 is further folded until the inner panel 430 is adhered to the exterior panel 418, specifically panel 418*a* (step V). Lower end panel 418*b* is not affixed to adjacent portions of panel 430. Inner end panel side flaps 432, 434 may be adhesively affixed to end panel upper side flaps 422*a*, 426*a* but not to end panel lower side flaps 422*b*, 426*b*. At this point in the process, the wrapper blank is formed into a square "U"-shape.

Preferably, the folded blank 400 is now loaded with product, e.g., bottles, by pushing the product onto and over bottom panel 412 (step VI). After insertion of the product (e.g., bottles), one of panels 482, 483 is folded perpendicular to center panel 480 so that divider 402 forms an "L"-shape (step VII), and divider 402 is then dropped down among the array of product (step VIII). The remaining one of panels 482, 483 is then folded perpendicular to center panel 480, so that divider 402 assumes a "C"-shape, and flaps 422, 426, 424, 428 are folded 90° inwardly (step IX). Top panel 436 is folded downwardly parallel to bottom panel 412 (step X). Adhesive is then applied to panels 414, 416 (or to the corresponding surfaces of panels 422, 424, 426, 428), which are then are folded up and adhered in place, and adhesive is then applied to panels 438, 440, (or to the corresponding surfaces of panels 422, 426, but not panels 424, 428), which are then are folded down and adhered in place (step XI). Glue flap 470 is then folded down and adhesively affixed to panel 418*a* (step XII).

Figure 23:
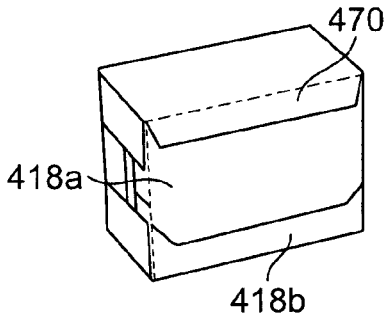
FIG. 23 is a perspective view of a container formed with the wrapper of FIG. 20.
Figure 24:
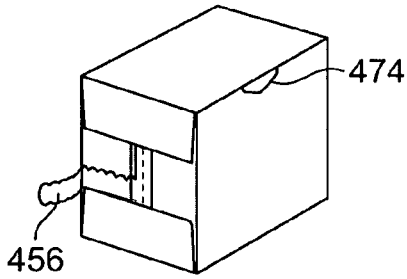
FIG. 24 is a front perspective view of the container formed from the wrapper of FIG. 20, showing the zipper pull strips partially torn away, and a rear perspective view of the container of FIG. 21, showing the zipper pull strips partially torn away.
Figure 25:
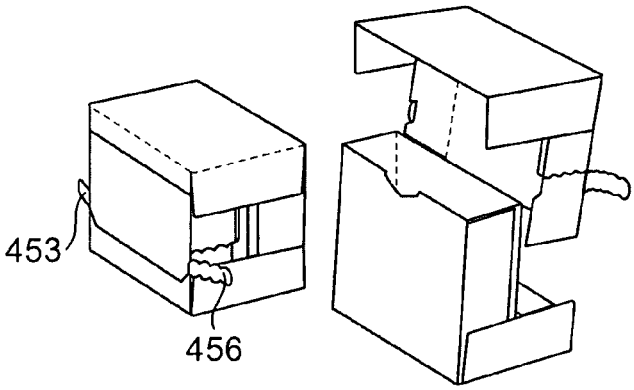
FIG. 25 is a perspective exploded view of the container of FIGS. 21–22, showing the upper portion of the wrapper separated from the remaining display tray portion and divider.
Figure 26:
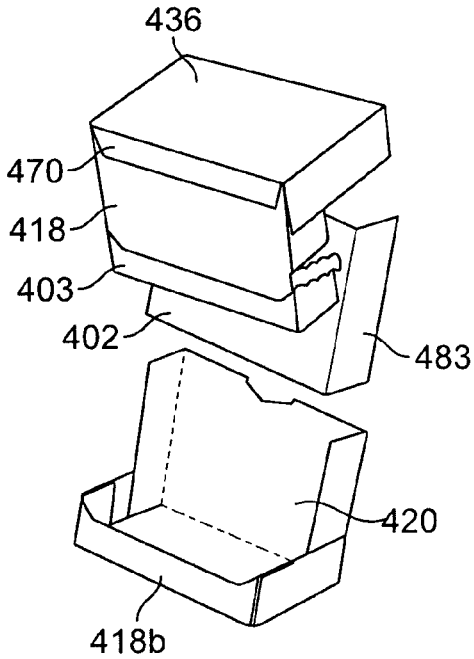
FIG. 26 is an exploded perspective view of the container of FIGS. 21–23, showing both the upper portion of the wrapper and the divider being separated from the remaining display tray portion.

Once the folding and gluing process has been completed, the result is a container 401, as shown in a perspective view in FIG. 23; The process of opening container 401 begins, as shown in FIGS. 24 and 25, by pulling out the zipper pull strips 453, 456. Next, upper end panel 418*a* is separated from lower end panel 418*b*, either by joining cuts 446, 447 by knife cutting along score line 445 (or if line 445 is a perforation line, breaking the perforations). See FIG. 25. Top panel 436 is separated from panel 420, by hand insertion into cut out 474, and pulling upward on top panel 436, tearing panel 436 away along perforation line 466. The connections between upper end panel 418*a* and lower end panel 418*b*, and between top panel 436 and panel 420 being the only structural connection (aside from the pull strips), keeping the upper portion of the wrapper 400 (and divider 402, which has not been adhered to anything) connected to the lower portion of wrapper 400, the upper portion of the wrapper becomes readily separable from the lower, remaining tray portion of wrapper 400, as shown in FIG. 25.

The foregoing description and drawings merely explain and illustrate the invention and the invention is not limited thereto, as those skilled in the art who have the disclosure before them will be able to make modifications and variations therein without departing from the scope of the invention.

What is claimed is:

1. A shipping container convertible to a display container, having a top, a bottom, first and second sides and first and second ends, comprising:

an outer cover member formed from a first blank, including a bottom panel for forming the bottom of the shipping container, first and second side panels, emanating from first and second opposing sides of the bottom panel, first and second end panels, emanating from first and second opposing ends of the bottom panel, the first and second end panels further including a bottom portion, a top portion, at least one of the first and second end panels further including a zone of weakness enabling separation of the bottom portion from the top portion of the at least one of the first and second end panels, at least one reinforcement panel, emanating from a top edge region of at least one of the first and second end panels, and disposed in juxtaposed overlying relation to an inside surface of said at least one of the first and second end panels, and affixed to an upper portion thereof, minor flaps emanating from opposing end edges of at least one of the first and second end panels, the minor flaps and the at least one of the first and second end panels from which the minor flaps emanate each having an upper portion and a lower portion;

a zone of weakness passing through the minor flaps and the at least one of the first and second end panels from which the minor flaps emanate;

a top panel, affixed to the top portion of at least one of the first and second end panels, the shipping container convertible to a display container being operably configured, upon severing along the zone of weakness, to enable an upper portion of the shipping container to be completely separated from a lower portion of the shipping container, leaving a structurally sound tray for containing and displaying articles.

2. The shipping container according to claim 1, wherein both of the first and second end panels include a zone of weakness enabling separation of the bottom portion from the both of the first and second end panels.

3. The shipping container according to claim 1, wherein the top panel is fabricated from a second blank of material discrete and separate from the first blank.

4. The shipping container according to claim 1, wherein the top panel is monolithically formed with and emanates from one of the first and second end panels.

5. The shipping container according to claim 4, the top is joined to said one of the first and second end panels along a line of weakness, which enables manual separation of the top panel from said one of the first and second end panels.

6. The shipping container according to claim 1, further comprising at least one minor flap emanating from a side edge of the at least one reinforcement panel, and disposed so as to be juxtaposed to and in overlying relation to an inside surface of the at least one minor flap emanating from a side edge of said at least one of the first and second end panels.

7. The shipping container according to claim 2, further comprising two reinforcement panels, emanating from top edge regions of each of the first and second end panels, and disposed in juxtaposed overlying relation to inside surfaces of the respective first and second end panels and affixed to upper portions thereof.

8. The shipping container according to claim 5, further comprising an aperture disposed in said end panel, for facilitating removal of the top panel.

9. The shipping container according to claim 1, wherein the zone of weakness is at least one of the following: a score line; a pull strip; at least one transverse line of perforations.

10. The shipping container according to claim 1, wherein the top panel further comprises at least one side flap, releasably adhered to a top portion of said at least one minor flap emanating from a side edge of said at least one of the first and second end panels, for enabling separation of the at least one side flap from the at least one minor flap, for further enabling separation of the top portion of said at least one minor flap from the bottom portion of the at least one minor flap.

* * * * *